US009578409B1

(12) United States Patent
Crockran, Jr.

(10) Patent No.: US 9,578,409 B1
(45) Date of Patent: Feb. 21, 2017

(54) HEADGEAR FOR RECEIVING AND HOLDING PORTABLE AUDIO DEVICE AND EARPHONES

(71) Applicant: John Crockran, Jr., Chicago, IL (US)

(72) Inventor: John Crockran, Jr., Chicago, IL (US)

( * ) Notice: Subject to any disclaimer, the term of this patent is extended or adjusted under 35 U.S.C. 154(b) by 0 days.

(21) Appl. No.: 14/754,448

(22) Filed: Jun. 29, 2015

Related U.S. Application Data

(63) Continuation-in-part of application No. 13/839,665, filed on Mar. 15, 2013, now Pat. No. 9,071,903.

(51) Int. Cl.

| | |
|---|---|
| ***H04R 25/00*** | (2006.01) |
| ***H04R 1/10*** | (2006.01) |
| ***A42B 1/00*** | (2006.01) |
| ***A42B 1/24*** | (2006.01) |

(52) U.S. Cl.
CPC ..... *H04R 1/105* (2013.01); *A42B 1/006* (2013.01); *A42B 1/241* (2013.01); *A42B 1/245* (2013.01)

(58) Field of Classification Search
USPC ..... 381/367, 376
See application file for complete search history.

(56) References Cited

U.S. PATENT DOCUMENTS

| | | | | |
|---|---|---|---|---|
| 8,009,847 | B2 * | 8/2011 | Planansky | H04R 5/02 2/422 |
| 2009/0210995 | A1 * | 8/2009 | Kwon | A42B 1/245 2/209.13 |

* cited by examiner

*Primary Examiner* — Amir Etesam
(74) *Attorney, Agent, or Firm* — Brie A. Crawford

(57) ABSTRACT

A piece of headgear or hat is capable of holding and storing an audio device and an earphone or headphone assembly either while the headgear or hat is in use or while it is stored. The headgear or hat has a pocket accessible from an exterior to accept and store the audio device and allow a user to manipulate and use the audio device without removing the headgear or hat. The headgear or hat also has a plurality of apertures so that the common wire set of the earphones or headphones can be threaded and contained therein. The earphone or headphone assembly and the audio device are removable from the headgear or hat for repair, replacement or cleaning.

8 Claims, 4 Drawing Sheets

HEADGEAR FOR RECEIVING AND HOLDING PORTABLE AUDIO DEVICE AND EARPHONES

CROSS REFERENCE TO RELATED APPLICATION AND INCORPORATION BY REFERENCE

This application is a continuation-in-part of and claims priority to the previously filed United States of America Utility Patent Application titled HEADGEAR FOR RECEIVING AND HOLDING PORTABLE AUDIO DEVICE AND EARPHONES with an application filing date of Mar. 15, 2013, in the United States Patent and Trademark Office, application Ser. No. 13/839,665, by the same inventive entity, the entirety of said application being incorporated herein by reference in its entirety to provide continuity of disclosure. A Notice of Allowance was granted on application Ser. No. 13/839,665 on Feb. 27, 2015 and at the time of filing this continuation-in-part application, the Ser. No. 13/839,665 application is still pending and has not issued as a patent.

FIELD OF THE INVENTION

This invention relates to a piece of headgear or a hat and more particularly to a piece of headgear or a hat for receiving and holding an audio device and an earphone or headphone assembly in a convenient position for use while a user is wearing the headgear or hat.

BACKGROUND OF THE INVENTION

Portable audio devices are becoming an increasingly common presence in everyday life. Portable audio devices are becoming smaller in weight and size and thus making it easier to transport these devices throughout the routines of everyday life. For example, people take portable audio devices to work, school, on the bus or train, to exercise, and to various other places and activities.

There are difficulties in the transportation and use of portable audio devices and the associated earphone or headphone assemblies because the user generally places the speakers of the earphone or headphone assembly over their ears but must carry the portable audio device in their hand or store it in a clothing pocket. Carrying the portable audio device in the hand is cumbersome and makes it difficult to perform other activities while listening to music or other audio output from the portable audio device. Storing the portable audio device in a clothing pocket results in wires hanging around the face and neck and can be uncomfortable if not dangerous. Also, when a user is listening to a portable audio device, it is difficult to conceal the activity as the earphone or headphone assembly and the portable audio device are visible to third parties.

Moreover, during transportation and use, the audio device and the earphone or headphone assembly is exposed to the elements and adverse environmental conditions. This exposure such as rain or snow may result in damage to the audio device or earphone or headphone assembly. This damage can be costly to repair and replacement of the damaged components may be necessary.

It is a useful invention to create headgear or a hat that can receive and hold a portable audio device and an earphone or headphone assembly and allow a user to listen to music or other sound originating from the audio device and being transferred through the speakers in a manner than reduces the amount of exposed, dangling or uncomfortable wires.

Also, it is a useful invention to create headgear or a hat that conceals the portable audio device and the earphone or headphone assembly while the user is utilizing the set.

It is further useful to have headgear or a hat that allows for ease of removability of the audio device, which includes cell phones, for the purpose of accessing controls and functions of said device while in use. Or, ease of removability allows for replacement or repair of the earphone or headphone assembly if it becomes damaged in any way thus extending the life of the headgear or hat.

SUMMARY OF THE INVENTION

Among the many objectives of the present invention is the provision of headgear or a hat for receiving and holding an audio device and allowing for the insertion of an earphone or headphone assembly, in a minimally exposed fashion, which allows the speakers to be placed near the ears of a user when wearing the headgear or hat.

Furthermore, an objective of the present invention is the provision of headgear or a hat for receiving and holding an audio device and an earphone or headphone assembly which stores the audio device in a pocket of the headgear or hat to free the hands of the user for other activities.

Another objective of the present invention is the provision of headgear or a hat which provides an easy structure for receiving and holding an audio device and an earphone or headphone assembly and which conceals both the audio device and the earphone or headphone assembly from the view of a third party when in use.

Still another objective of the present invention is the provision of headgear or a hat for holding an audio device which facilitates ease of insertion and removal of an earphone or headphone assembly and which headgear or hat contains a majority or all of the wiring within the headgear or hat during use to reduce safety and comfort concerns and protects the components from the elements or the environment.

Moreover, an objective of the present invention is the provision of headgear or a hat for receiving and holding an audio device and an earphone or headphone assembly which allows adjustment of the settings or use of the audio device without removing the headgear from the head of the wearer.

Yet another objective of the present invention is the provision of headgear or a hat with the capability to receive audio components in a fashion that allows ease of removability of the audio device and an earphone or headphone assembly for replacement, repair or cleaning.

These and other objectives of the invention (which other objectives become clear by consideration of the specification, drawings, and claims as a whole) are met by providing a hat or other headgear which has a pocket for receiving the audio device and a series of hangers for receiving the earphone or headphone assembly and a plurality of apertures to provide access between the wires of the earphone or headphone assembly and the audio device.

BRIEF DESCRIPTION OF THE DRAWINGS

Throughout the figures of the drawings, where the same part appears in more than one figure of the drawings, the same number is applied thereto.

DETAILED DESCRIPTION OF THE PRESENT INVENTION

Figure 1:
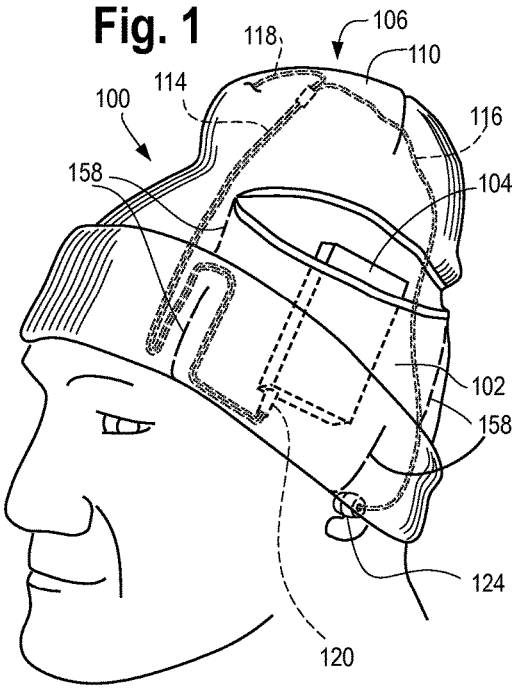
FIG. 1 depicts a left side, exterior perspective view of headgear or hat 100 in use with audio device 104, common wire set 114, left wire set 116, right wire set 118, and jack 120 depicted in phantom.
Figure 4:
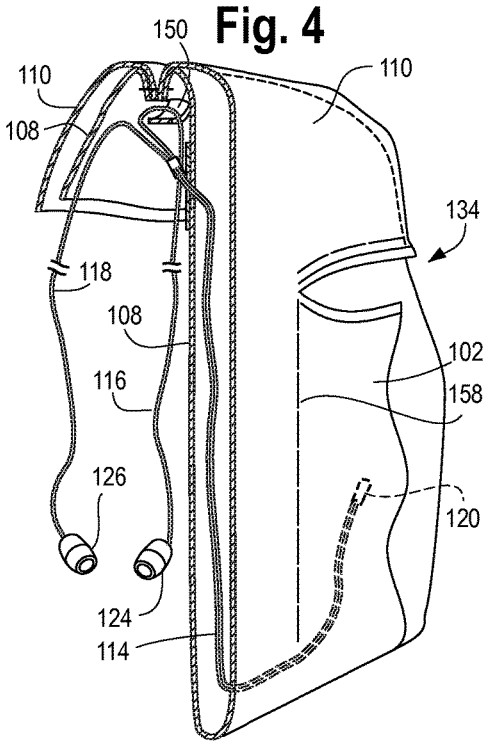
FIG. 4 depicts a cut away, exterior perspective view of headgear or hat 100 with a cut away view of pocket 102 and pocket 102 and common wire set 114 are partially depicted in phantom and jack 120 is completely depicted in phantom.
Figure 2:
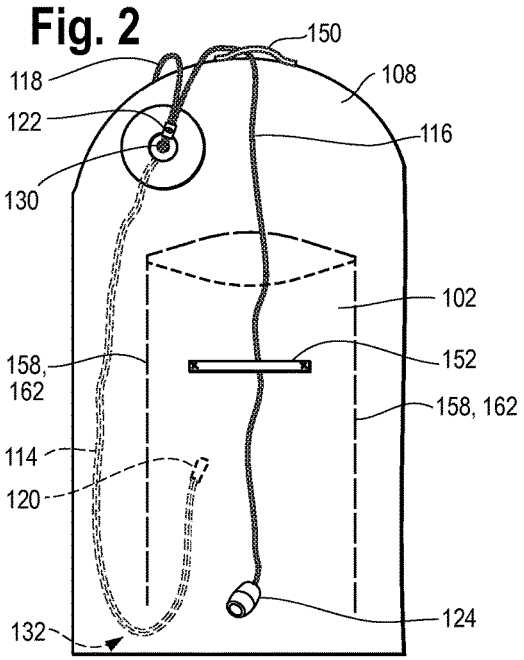
FIG. 2 depicts an inside out left plan view of headgear or hat 100 with pocket 102, common wire set 114 and jack 120 depicted in phantom.
Figure 3:
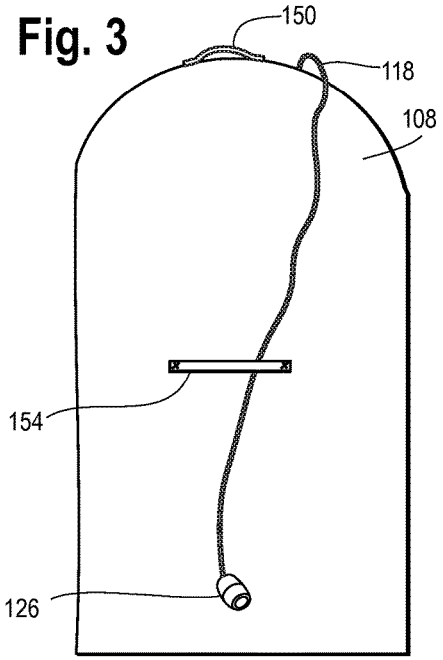
FIG. 3 depicts an inside out right plan view of headgear or hat 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

The headgear or hat of this invention has an adequate pocket to receive an expansive variety of audio devices, as well as a series of optional hangers to receive the headphone or earphone assembly, and a plurality of apertures to provide access for the wires of the earphone or headphone assembly to connect with the audio device in a protected fashion.

Headgear or hat is meant to encompass any hat, cap, or other wearing apparel for the head which can receive and hold an audio device and an earphone or headphone assembly and all such suitable examples are encompassed by this disclosure. In the preferred embodiment, headgear or hat is a double layer cap or beanie. However, another preferred embodiment of headgear or hat is a single layer. Moreover, headgear or hat is meant to be made of any suitable material and all suitable materials are encompassed by this disclosure. However, in the preferred embodiment, knit, fleeces, or nylon are the preferred material.

The audio device can be any suitable device for playing stored music or audio material and all such suitable devices are encompassed by this disclosure. The audio device can be a MP3 player or any music or media format player such as an IPOD®, IPOD is a registered United States Trademark, Registration Number 3,089,360, of Apple Computer Inc., a Corporation organized under the laws of the State of California, 1 Infinite Loop, Cupertino, Calif. 95014, a ZUNE®, ZUNE is a registered United States Trademark, Registration Number 3,294,152, of Microsoft Corporation, a Corporation organized under the laws of the State of Washington, One Microsoft Way, Redmond, Wash., 98052-6399, or a WALKMAN®, WALKMAN is a registered United States Trademark, Registration Number 2,621,931, of Sony Corporation TA Sony Corporation, a Corporation organized under the laws of Japan, 1-7-1 Konan, Minato-ku, Tokyo, Japan. Or, the audio device can be a cell phone such as an ANDROID®, ANDRIOD is a United States Trademark Application, Serial Number 77/318,565 of Google Inc., a Corporation organized under the laws of the State of Delaware, 1600 Amphitheatre Parkway, Mountain View, Calif. 94043 or an IPHONE®, IPHONE is a registered United States Trademark, Registration Number 3,877,185, of Apple Inc., a Corporation organized under the laws of the State of California, 1 Infinite Loop, Cupertino, Calif. 95014.

Earphone or headphone assembly can be any suitable assembly for connecting to the audio device and providing an audio output to the user and all such assemblies are encompassed by this disclosure. Such suitable assemblies include earbuds or other in ear assemblies as well as those that rest directly against the exterior of the ear.

Now adding FIG. 1, FIG. 2, FIG. 3, and FIG. 4 to the consideration, the structure of headgear or hat 100 can be clearly seen. Headgear or hat 100 is designed to receive, support and hold an audio device 104 and an earphone or headphone assembly 106 through a securing means. Earphone or headphone assembly 106 has common wire set 114, left wire set 116, right wire set 118, jack 120, bifurcation 122, left speaker 124, and right speaker 126. In this embodiment securing means has first aperture 130, gap 132, top hanger 150, left hanger 152, and right hanger 154.

The exterior layer 110 of headgear or hat 100 has slit 134 to form pocket 102 between the exterior layer 110 and the interior layer 108 to receive and store the audio device 104. Pocket 102 is designed to accommodate any audio device 104 as defined above. Thus, pocket 102 provides great advantages to the user because they are not limited to a particular style, brand, make or size of audio device 104 and can interchange audio devices 104 as desired for use with headgear or hat 100.

Optional pocket stitching 158 may be present to define side or vertical borders 162 of pocket 102. Pocket stitching 158 secures audio device 104 in a desired position between the exterior layer 110 and interior layer 108.

Pocket 102 is accessible from the exterior layer 110 of headgear or hat 100. Pocket 102 can be positioned on the front, back or side of the head of the user as desired. This exterior accessibility provides great advantages to a user for the purpose of access of audio player controls and audio device 104. Audio device 104 can be retrieved from pocket 102, the controls or volume adjusted, and the audio device 104 placed back into pocket 102 all while the user is wearing headgear or hat 100. This feature is especially beneficial if audio device 104 is a cell phone as the user can answer or use the cell phone without removing headgear or hat 100.

Headgear or hat 100 has top hanger 150 on the interior layer 108 near the top center. Headgear or hat 100 also has left hanger 152 and right hanger 154 on the respective sides of interior layer 108. Top hanger 150 receives left wire set 116 thereby supporting both wire sets 116 and 118 on headgear or hat 100 near bifurcation 122. Left wire set 116 is then received and supported by left hanger 152 and right wire set 118 is then received and supported by right hanger 154. The remaining portions of left wire set 116 and right wire set 118 extend beyond left hanger 152 and right hanger 154 and left speaker 124 and right speaker 126 are positioned against or received by the respective ears of the user. In the depicted embodiment, one top hanger 150, one left hanger 152, and one right hanger 154 are depicted but any suitable number of top hangers 150, left hangers 152, and right hangers 154 can be utilized with the present invention and is encompassed by this disclosure.

Top hanger 150, left hanger 152, and right hanger 154 do support the left wire set 116 and the right wire set 118 in a desired position in headgear or hat 100 and prevent the left wire set 116 and the right wire set 118 from tangling when not in use. Also, top hanger 150, left hanger 152, and right hanger 154 aid in positioning left speaker 124 and right speaker 126 in the desired position in regard the respective ears of the user when in use. Headgear or hat 100 with top hanger 150, left hanger 152, and right hanger 154 accommodates varying sizes and shapes of heads of users based on the variance of sizes for headgear or hat 100.

This arrangement of headgear or hat 100 provides great benefits to the user as speakers 124 and 126 are directly positioned in or against the ears without interference from interior layer 108 or exterior layer 110. Thus, the user is able to experience the full listening enjoyment and experience without interference from the material of headgear or hat 100.

Headgear or hat 100 has a first aperture 130 and a gap 132 which cooperate in providing easy storage for common wire set 114 but still allow jack 120 to connect to audio device 104. First aperture 130 is on interior layer 108 and is located near the top of headgear or hat 100. In the depicted embodiment, first aperture 130 is a gasket however any suitable method for forming first aperture 130 can be utilized and is encompassed by this disclosure. Another suitable embodiment for first aperture 130 is a buttonhole or grommet.

First aperture 130 allows jack 120 and common wire set 114 to be threaded between the interior layer 108 and exterior layer 110. Gap 132 is a gap in pocket stitching 158 above the bottom of headgear or hat 100. Gap 132 allows jack 120 and common wire set 114 to be threaded around pocket stitching 158 into pocket 102 so that jack 120 can be received by audio device 104. Also, gap 132 allows the user to remove the audio device 104 from pocket 102 without removing hat or headgear 100. Common wire set 114 can be threaded through gap 132 to provide enough extension for the user to adjust the controls on the audio device 104 or answer or otherwise use the cell phone audio device 104 without removal of headgear or hat 100.

The threading of the common wire set 114 through the first aperture 130 allows the majority of wire set 114 to be stored between the exterior layer 110 and interior layer 108. Since common wire set 114 is securely contained between the exterior layer 110 and the interior layer 108, the user is not inconvenienced by the excess wire. This storage capability of headgear or hat 100 provides both comfort and safety benefits and protects common wire set 114 from the elements and damage due to activity.

Figure 5:
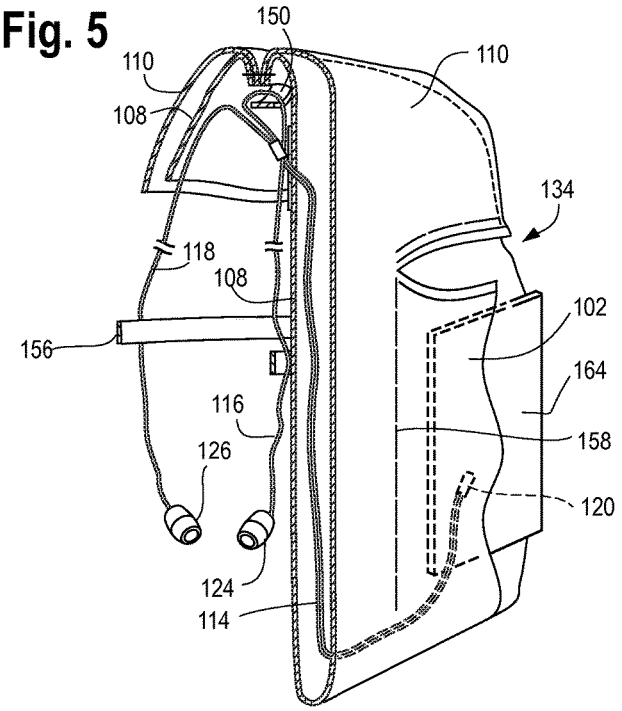
FIG. 5 depicts a cut away, exterior perspective view of headgear or hat 100 with a cut away view of pocket 102 and pocket 102, common wire set 114, and support piece 164 are partially depicted in phantom and jack 120 is completely depicted in phantom.
Figure 7:
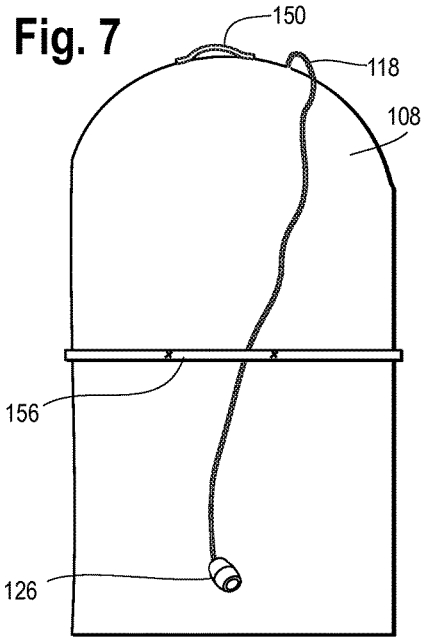
FIG. 7 depicts an inside out right plan view of headgear or hat 100 of this invention.

Now adding FIG. 5 and FIG. 7 to the consideration, more features of headgear or hat 100 can be clearly seen. In an alternative embodiment, left hanger 152 and right hanger 154 are replaced by hanging band 156 and securing means has first aperture 130, gap 132, top hanger 150, and hanging band 156.

Left wire set 116 and right wire set 118 are received on respective sides by hanging band 156 and extend beyond hanging band 156 such that left speaker 124 and right speaker 126 are positioned directly against or received by the respective ear of the user as desired. As in the previous embodiment, hanging band 156 cooperates with top hanger 150 to position left wire set 116 and right wire set 118 in a desired position when in use and to prevent tangling when headgear or hat 100 is not in use. Hanging band 156 also further secures headgear or hat 100 against the head of the user.

Hanging band 156 may be made of any suitable material which provides a secure yet adjustable and removable attachment between left wire set 116, right wire set 118 and interior layer 108 and all suitable materials are encompassed by this disclosure. However, in the preferred embodiment, hanging band 156 is made of elastic.

This arrangement of headgear or hat 100 provides great benefits to the user as speakers 124 and 126 are directly positioned in or against the ears without interference from interior layer 108 or exterior layer 110. Thus, the user is able to experience the full listening enjoyment and experience without interference from the material of headgear or hat 100.

Now referring specifically to FIG. 5, support piece 164 can be clearly seen. Support piece 164 can be securely attached to the interior layer 108, exterior layer 110 or two support pieces 164 can be present and one attached to each the interior layer 108 and the exterior layer 110 of pocket 102. Support piece 164 acts as a stiffener and facilitates insertion and removal of the audio device 104 into and from pocket 102. Support piece 164 can also protect the audio device 104 from damage.

Figure 6:
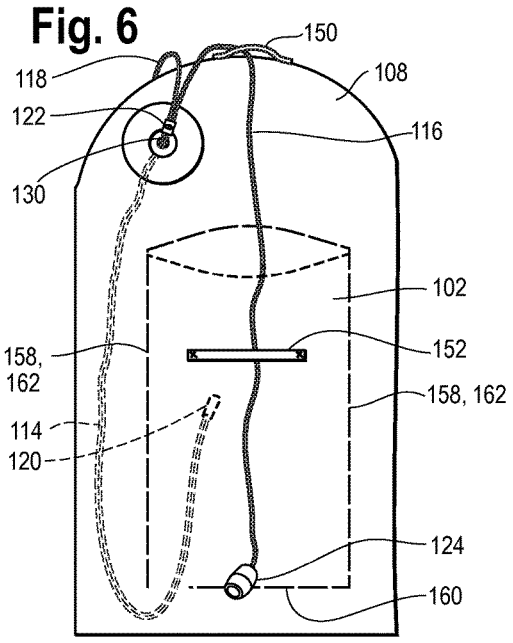
FIG. 6 depicts an inside out left plan view of headgear or hat 100 with pocket 102, common wire set 114 and jack 120 depicted in phantom.

Now adding FIG. 6 to the consideration, additional features of headgear or hat 100 can be clearly seen. Pocket 102 may have optional support stitching 160 to provide support for audio device 104 while stored in pocket 102. Support stitching 160 provides support for the weight of the audio device 104 while it is stored in pocket 102. Support stitching 160 reduces or eliminates any bulging effect at the bottom of pocket 102 that may be exteriorly viewable on the base of headgear or hat 100.

The headgear or hat 100 of the present invention provides great advantages to the user. The user is able to listen to the audio device 104 through the earphone or headphone assembly 106 and both components are concealed from the view of third parties. The audio device 104 is concealed by the pocket 102 and the earphone or headphone assembly 106 is concealed by the headgear or hat 100.

Also, audio device 104 and earphone or headphone assembly 106 can be removed from headgear or hat 100 for replacement, repair or washing. Audio device 104 is disconnected from jack 120 and removed from pocket 102 through slit 134. Left wire set 116 is removed from top hanger 150 and left hanger 152 or hanging band 156 and right wire set 118 is removed from right hanger 154 or hanging band 156. Common wire set 114 and jack 120 are threaded through gap 132 and then first aperture 130. This removability provides great benefits as the earphone or headphone assembly 106 can be replaced if it is damaged without the need to replace headgear or hat 100 and thereby extending the life of headgear or hat 100. Also, headgear or hat 100 can be washed and cleaned without damage to earphone or headphone assembly 106 or audio device 104.

Figure 9:
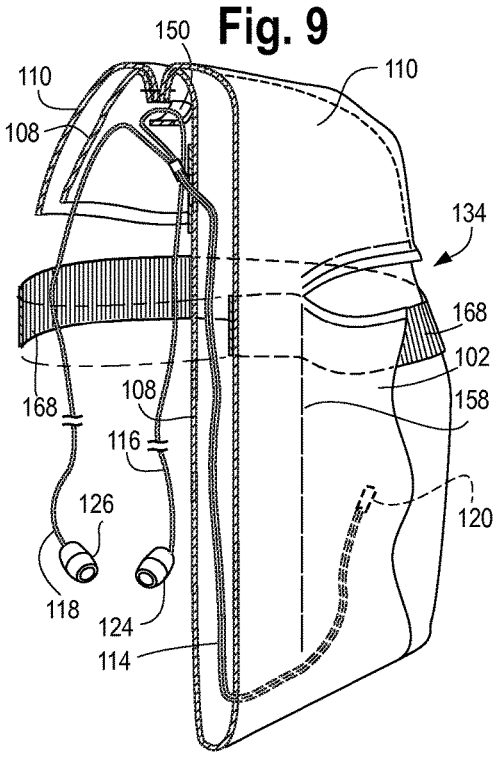
FIG. 9 depicts a cut away, exterior perspective view of headgear or hat 100 with a cut away view of pocket 102 and pocket 102, common wire set 114, and elastic band 168 are partially depicted in phantom and jack 120 is completely depicted in phantom.
Figure 10:
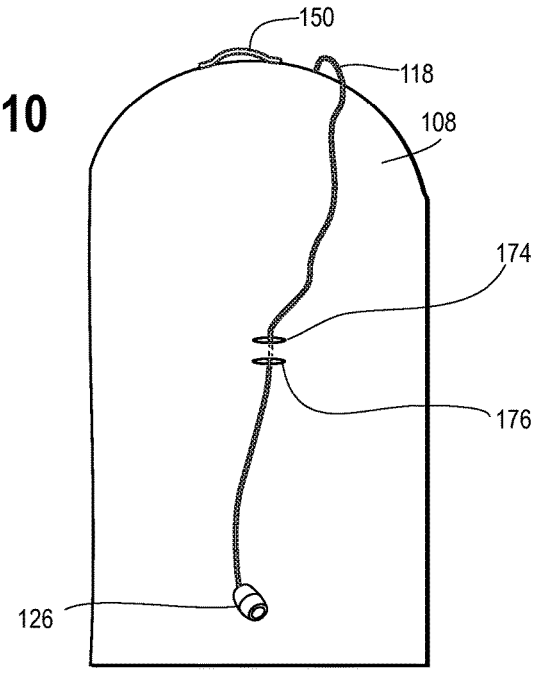
FIG. 10 depicts an inside out right plan view of headgear or hat 100 of this invention.
Figure 11:
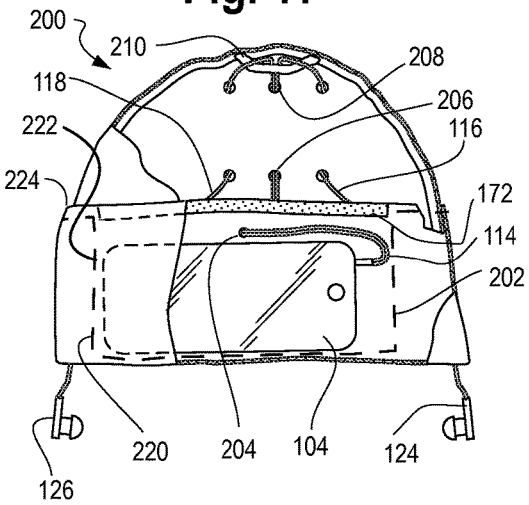
FIG. 11 depicts a cut away, front perspective view of headgear or hat 200 of this invention with audio device 104 and hook and loop assembly 172 partially depicted in phantom.
Figure 12:
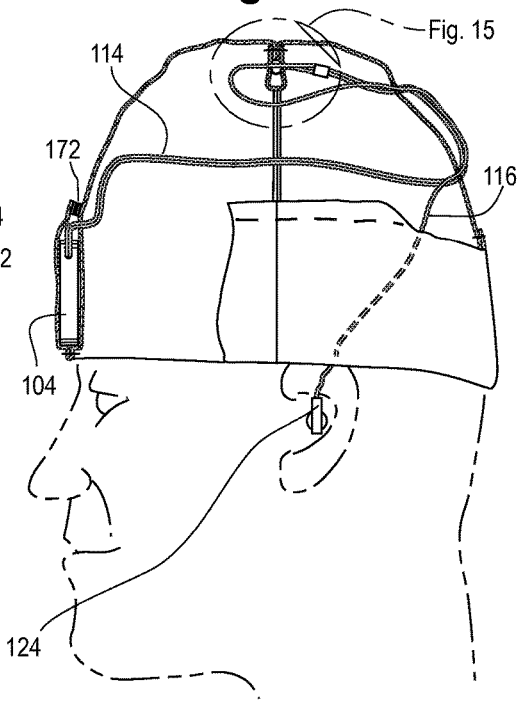
FIG. 12 depicts a cut away, left side view of headgear or hat 200 in use with audio device 104 and with left wire set 116 partially depicted in phantom.
Figure 13:
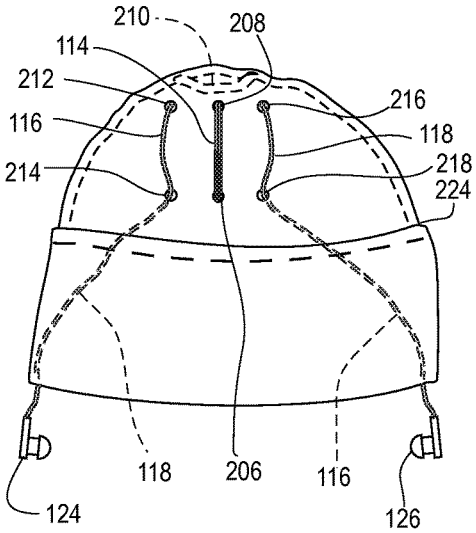
FIG. 13 depicts a rear perspective view of headgear or hat 200 with left wire set 116 and right wire set 118 partially depicted in phantom.

Now adding FIG. 8, FIG. 9, FIG. 10 and FIG. 11 to the consideration, further features of headgear or hat 100 can be clearly seen. In this embodiment, pocket 102 can be created as previously described. Or, pocket 102 can be created by upwardly folding the lower edge of headgear or hat 100 to create an overlap. Optional pocket stitching 158 may be present to define side or vertical borders 162 of pocket 102. Pocket stitching 158 secures audio device 104 in a desired position between the overlap created by upwardly folding the lower edge of headgear or hat 100. This embodiment is depicted in FIG. 11 for headgear or hat 200 but the same method applies to headgear or hat 100.

Figure 8:
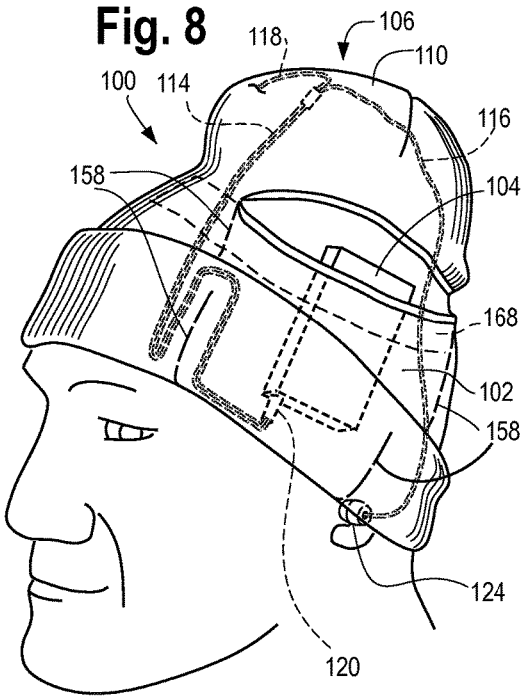
FIG. 8 depicts a left side, exterior perspective view of headgear or hat 100 in use with audio device 104, common wire set 114, left wire set 116, right wire set 118, jack 120, and elastic band 168 depicted in phantom.

Referring specifically to FIG. 8 and FIG. 9, elastic band 168 can be seen. Elastic band 168 serves a dual purpose. First, elastic band 168 releasably closes pocket 102 so that the audio device 104 remains in pocket 102 during use. Secondly, elastic band 168 serves to securely and firmly attach headgear or hat 100 to the wearer's head.

Elastic band 168 is a continuous band around the diameter of headgear or hat 100. Elastic band 168 is securely attached between the interior layer 108 and exterior layer 110 at the open end of pocket 102 to allow easy opening and closing of pocket 102. Elastic band 168 may be secured at the edge of slit 134. Or, elastic band 168 may be secured between the interior layer 108 and exterior layer 110 at the lower edge of headgear or hat 100 when lower edge is folded and overlapped to create pocket 102. Elastic band 168 may be secured by stitching, gluing or any other suitable fastening device which is encompassed by this disclosure.

Referring specifically to FIG. 10, left hanger 152 and right hanger 154 can be replaced with top and bottom threading apertures 174 and 176. A set of threading apertures 174 and 176 can be present on both the interior of the right side and the left side of headgear or hat 100. Left wire set 116 and right wire set 118 first thread between the interior layer 108 and the exterior layer 110 through the top threading aperture 174. Then, the left wire set 116 or the right wire set 118 reenters the interior of headgear or hat 100 through the bottom threading aperture 176. Left hanger 152, right hanger 154 and threading apertures 174 and 176 are the preferred embodiments but, any suitable embodiment for positioning the speaker wire sets 116 and 118 and speakers 124 and 126 can be used and are encompassed by this disclosure.

Referring specifically to FIG. 11 and adding FIG. 12, FIG. 13, FIG. 14 and FIG. 15 to the consideration, the structure and function of headgear or hat 200 of this invention becomes clear. Headgear or hat 200 functions similarly as headgear or hat 100. However, headgear or hat 200 is a single layer instead of a double layer.

Headgear or hat 200 has pocket 202 to receive audio device 104. Pocket 202 is created by upwardly folding the lower edge 224 of headgear or hat 200 to create an overlap. Optional pocket stitching 220 may be present to define side or vertical borders 222 of pocket 202. Pocket stitching 220 secures audio device 104 in a desired position between the overlap created by upwardly folding the lower edge 224 of headgear or hat 200.

Figure 14:
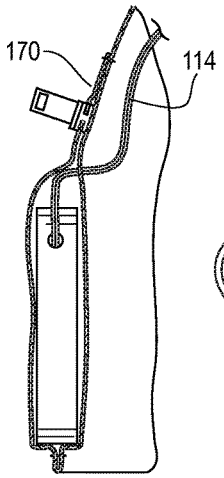
FIG. 14 depicts a cut away, left side view of pocket 202 securing audio device 104 with zipper 170.
Figure 15:
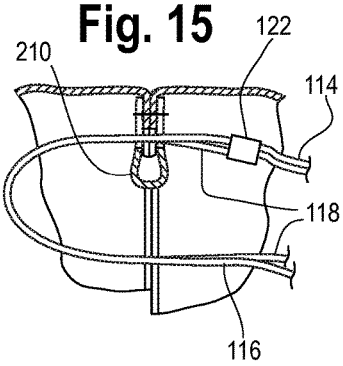
FIG. 15 depicts a detailed view as referenced by FIG. 12 of headgear or hat 200 of this invention.

Pocket 202 can be securely but releasably closed with either hook and loop assembly 172 (FIG. 11) or zipper 170 (FIG. 14) to securely contain and protect audio device 104. Hook and loop assembly 172 and zipper 170 can also be added to headgear or hat 100 as previously described in the same manner and fashion as depicted in FIG. 11 and FIG. 14.

Headgear or hat 200 has first common wire aperture 204. Common wire set 114 connects to audio device 104 inside of pocket 202. Common wire set 114 enters first common wire aperture 204, passes through the interior of the headgear or hat 200 and over the wearer's head. Common wire set 114 then exits the rear of headgear or hat 200 at second common wire aperture 206. Common wire set 114 then reenters the interior of headgear or hat 200 through third common wire aperture 208, bifurcates at bifurcation 122 into left wire set 116 and right wire set 118 and wire sets 116 and 118 engage with top hanger 210. Top hanger 210 securely holds left wire set 116 and right wire set 118 in the desired position.

From top hanger 210, left wire set 116 and right wire set 118 exit the interior of the headgear or hat 200 through first left wire set aperture 212 and first right wire set aperture 216. Then, left wire set 116 and right wire set 118 reenter headgear or hat 200 through second left wire set aperture 214 and second right wire set aperture 218. Then, the left wire set 116 and the right wire set 118 terminate at left speaker 124 and right speaker 126 and extend to the wearer's ears.

While various embodiments and aspects of the present invention have been described above, it should be understood that they have been presented by way of example only, and not limitation. Thus, the breadth and scope of the present invention should not be limited by any of the above exemplary embodiments.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and system can become clear to a person having ordinary skill in this particular art. Such modifications are clearly covered by this disclosure.

What is claimed and sought to be protected by Letters Patent of the United States is:

1. A piece of headgear or hat for receiving and holding an audio device and an earphone or headphone assembly comprising:

a) the headgear or hat having a pocket to receive and store the audio device;

b) the headgear or hat having an interior and an exterior;

c) the headgear or hat having a securing means to secure the earphone or headphone assembly to the headgear or hat in a desired position;

d) the pocket having at least two side borders defined by at least two lines of pocket stitching and at least one open side;
e) the pocket receiving the audio device through the open side;
f) the headgear or hat having an interior layer and an exterior layer securely attached to each other;
g) the exterior layer having a slit to form an opening between the exterior layer and the interior layer;
h) the pocket being formed through the interaction of the slit, the exterior layer, the interior layer, and the at least two lines of pocket stitching;
i) the pocket receiving the audio device through the exterior slit;
j) the securing means having at least one aperture;
k) the first aperture being located on the interior layer and allowing a jack and a common wire set to be inserted between the exterior layer and the interior layer;
l) at least one of the at least lines of pocket stitching having a gap of interrupted stitching sufficient to allow the jack to insert into the audio device, contained inside the pocket, from the common set of wires within the interior layer and the exterior layer;
m) the first aperture and the gap allowing the threading and storage of the common set of wires between the interior layer and the exterior layer, as a method of containment of the common set of wires, up to the gap of interrupted stitching at the pocket;
n) the audio device and the earphone or headphone assembly all being contained securely within the headgear or hat during use;
o) the audio device being accessible from the exterior pocket of the headgear or hat while the headgear or hat is worn by a user allowing for the removal, control, use and manipulation of the audio device without removing the headgear or hat from a head of the user;
p) an elastic band being attached to the headgear or hat;
q) the pocket being releasably closed with a zipper or with a hook and loop assembly;
r) the securing means having at least one aperture to receive a common wire set;
s) the securing means having at least one aperture to receive a right wire set and at least one aperture to receive a left wire set;
t) the securing means having at least one top hanger;
u) the at least one aperture to receive the common wire set being a first common wire aperture, a second common wire aperture and a third common wire aperture;
v) the at least one aperture to receive the receive the wire set being a first right wire set aperture and a second right wire set aperture; and
w) the at least one aperture to receive the left wire set being a first left wire set aperture and a second left wire set aperture.

2. The headgear or hat of claim 1 further comprising:
a) the headgear or hat having a lower edge;
b) the pocket being created by folding the lower edge upward over the exterior of the headgear or hat;
c) the lower edge being folded to create a top edge of the pocket; and
d) a crease being formed by folding to create a bottom edge of the pocket.

3. The headgear or hat of claim 2 further comprising:
a) the pocket being releasably closed with a zipper or with a hook and loop assembly;
b) a left speaker and a right speaker being attached to the left wire set and the right wire set and secured directly against or within a respective ear of the user when in use without interference from the headgear or hat to impede enjoyment of a listening experience;
c) the containment of the audio device and the earphone or headphone assembly within the headgear or hat allowing the user to utilize the audio device without being visible to at least one third party; and
d) the audio device being accessible from the exterior pocket of the headgear or hat while the headgear or hat is worn by a user allowing for the removal, control, use and manipulation of the audio device without removing the headgear or hat from a head of the user.

4. An improvement in a piece of headgear or a hat, the improvement comprising:
a) the headgear or hat having a pocket to receive and store the audio device;
b) the headgear or hat having an interior and an exterior;
c) the headgear or hat having a securing means to secure an earphone or headphone assembly to the headgear or hat in a desired position;
d) the pocket having at least two side borders defined by at least two lines of pocket stitching and at least one open side;
e) the pocket receiving the audio device through the open side;
f) the headgear or hat having an interior layer and an exterior layer securely attached to each other;
g) the exterior layer having a slit to form an opening between the exterior layer and the interior layer;
h) the pocket being formed through the interaction of the slit, the exterior layer, the interior layer, and the at least two lines of pocket stitching;
i) the pocket receiving the audio device through the exterior slit;
j) the securing means having at least one aperture;
k) the first aperture being located on the interior layer and allowing a lack and a common wire set to be inserted between the exterior layer and the interior layer;
l) at least one of the at least two lines of pocket stitching having a gap of interrupted stitching sufficient to allow the jack to insert into the audio device, contained inside the pocket, from the common set of wires within the interior layer and the exterior layer;
m) the first aperture and the gap allowing the threading and storage of the common set of wires between the interior layer and the exterior layer, as a method of containment of the common set of wires, up to the gap of interrupted stitching at the pocket;
n) the audio device and the earphone or headphone assembly all being contained securely within the headgear or hat during use;
o) the audio device being accessible from the exterior socket of the headgear or hat while the headgear or hat is worn by a user allowing for the removal, control, use and manipulation of the audio device without removing the headgear or hat from a head of the user;
p) an elastic band being attached to the headgear or hat;
q) the pocket being releasably closed with a zipper or with a hook and loop assembly;
r) the securing means having at least one aperture to receive a common wire set;
s) the securing means having at least one aperture to receive a right wire set and at least one aperture to receive a left wire set;
t) the securing means having at least one top hanger;

u) the at least one aperture to receive the common wire set being a first common wire aperture, a second common wire aperture and a third common wire aperture;

v) the at least one aperture to receive the right wire set being a first right wire set aperture and a second right wire set aperture; and w) the at least one aperture to receive the left wire set being a first left wire set aperture and a second left wire set aperture.

5. The improvement of claim 4 further comprising:

a) the headgear or hat having a lower edge;

b) the pocket being created by folding the lower edge upward over the exterior of the headgear or hat;

c) the lower edge being folded to create a top edge of the pocket; and d) a crease being formed by folding to create a bottom edge of the pocket.

6. The improvement of claim 5 further comprising:

a) the pocket being releasably closed with a zipper or with a hook and loop assembly;

b) a left speaker and a right speaker being attached to the left wire set and the right wire set and secured directly against or within a respective ear of the user when in use without interference from the headgear or hat to impede enjoyment of a listening experience;

c) the containment of the audio device and the earphone or headphone assembly within the headgear or hat allowing the user to utilize the audio device without being visible to at least one third party; and d) the audio device being accessible from the exterior pocket of the headgear or hat while the headgear or hat is worn by a user allowing for the removal, control, use and manipulation of the audio device without removing the headgear or hat from a head of the user.

7. A method of listening to music or other audio output from an audio device using a piece of headgear or a hat comprising:

a) providing the headgear or hat with a pocket to receive and store the audio device;

b) providing the headgear or hat with a securing means to secure an earphone or headphone assembly to the headgear or hat in a desired position;

c) connecting the audio device to the earphone or headphone assembly for use;

d) providing the pocket with at least two side borders defined by at least two lines of pocket stitching and at least one open side;

e) allowing the pocket to receive the audio device through the open side;

f) providing the securing means as having at least one aperture to receive a common wire set;

g) providing the securing means as having at least one aperture to receive a right wire set and at least one aperture to receive a left wire set;

h) providing the securing means with at least one top hanger;

i) providing the at least one aperture able to receive the common wire set as a first common wire aperture, a second common wire aperture and a third common wire aperture;

j) providing the at least one aperture as being able to receive the right wire set as a first right wire set aperture and a second right wire set aperture;

k) providing the at least one aperture as being able to receive the left wire set as a first left wire set aperture and a second left wire set aperture;

l) providing the headgear or hat with a lower edge;

m) creating the pocket by folding the lower edge upward over an exterior of the headgear or hat;

n) folding the lower edge to create a top edge of the pocket; and o) creating a crease by folding a bottom edge of the pocket.

8. The method of claim 7 further comprising:

a) releasably closing the pocket with a zipper or with a hook and loop assembly;

b) attaching a left speaker and a right speaker to the left wire set and the right wire set and directly securing them against or within a respective ear of the user when in use without interference from the headgear or hat to impede enjoyment of a listening experience;

c) containing the audio device and the earphone or headphone assembly within the headgear or the hat to allow the user to utilize the audio device without being visible to at least one third party; and d) providing the audio device as being accessible from the exterior pocket of the headgear or hat while the headgear or hat is worn by a user allowing for the removal, control, use and manipulation of the audio device without removing the headgear or hat from a head of the user.

* * * * *